US006693596B2

(12) United States Patent
Wakui et al.

(10) Patent No.: US 6,693,596 B2
(45) Date of Patent: Feb. 17, 2004

(54) DUAL-FREQUENCY ANTENNA

(75) Inventors: Masashi Wakui, Warabi (JP); Hiroshi Shimizu, Warabi (JP)

(73) Assignee: Nippon Antena Kabushiki Kaisha (JP)

( * ) Notice: Subject to any disclaimer, the term of this patent is extended or adjusted under 35 U.S.C. 154(b) by 0 days.

(21) Appl. No.: 10/111,331

(22) PCT Filed: Sep. 3, 2001

(86) PCT No.: PCT/JP01/07603

§ 371 (c)(1),
(2), (4) Date: Apr. 23, 2002

(87) PCT Pub. No.: WO02/21637

PCT Pub. Date: Mar. 14, 2002

(65) Prior Publication Data

US 2002/0171593 A1 Nov. 21, 2002

(30) Foreign Application Priority Data

Sep. 8, 2000 (JP) ..... 2000-273170

(51) Int. Cl.[7] ..... H01Q 9/00
(52) U.S. Cl. ..... 343/711; 343/752
(58) Field of Search ..... 343/711, 713, 343/872, 752, 712, 749, 828, 829, 830, 846, 848

(56) References Cited

U.S. PATENT DOCUMENTS 5,181,044 A * 1/1993 Matsumoto et al. ..... 343/752

* cited by examiner

*Primary Examiner*—James Clinger
(74) *Attorney, Agent, or Firm*—Connolly Bove Lodge & Hutz LLP

(57) ABSTRACT

An umbrella-shaped crown section 5*a* is provided on the front end of a linear element section 5*b*. The front end of the umbrella-shaped crown section 5*a* and the power supply section 6*a* at the lower end of the element section 5*b* are connected by means of a folded element 5*c*. Thereby, the dual-frequency antenna 5 is able to operate in two different frequency bands.

6 Claims, 20 Drawing Sheets f = 870MHz
GAIN=−1.04dB f = 915MHz
GAIN= −0.81dB f = 960MHz
GAIN= −1.53dB f = 1 7 1 0MHz
GAIN=− 1. 3 3 dB f = 1 7 9 5Hz
GAIN=− 0. 3 dB f = 1 8 8 0 MHz
GAIN= − 1 . 1 7 d B f = 870MHz
GAIN=−1. 23dB f = 915MHz
GAIN=−0.78dB f = 960MHz
GAIN=−1.67dB f = 1 7 1 0MHz
GAIN=−1. 8 1 dB f = 1 7 9 5Hz
GAIN=−0. 2 2 dB f = 1 8 8 0 H z
GAIN= − 0 . 0 4 d B f = 824MHz
GAIN=−1.19dB f = 8 5 9 MHz
GAIN = − 0 . 6 4 d B f = 8 9 4 MHz
GAIN = − 0 . 8 1 d B f = 1 8 5 0 MHz
GAIN= 1. 3 9 dB f = 1 9 2 0 Hz
GAIN= 1. 2 8 dB f = 1 9 9 0 H z
GAIN= 0. 5 d B

DUAL-FREQUENCY ANTENNA

TECHNICAL FIELD

The present invention relates to a dual-frequency antenna which operates in two frequency bands, and more particularly, to a dual-frequency antenna which is suitable for an antenna of a mobile telephone system which makes separate use of two frequency bands.

BACKGROUND ART

In general, a plurality of frequency bands are allocated for use in mobile telephone systems. For example, in the PDC system (Personal Digital Cellular telephone system) used in Japan, the 800 MHz band (810 MHz–956 MHz) and the 1.4 GHz band (1429 MHz–1501 MHz) are allocated, whilst in Europe, for example, the 900 MHz band (870 MHz–960 MHz) GSM (Global System for Mobile communications) and the 1.8 GHz band (1710 MHz–1880 MHz) DCS (Digital Cellular System) are used. Two frequency bands are allocated in this manner due to the shortage of usable frequencies that has arisen from the increase in the number of subscribers. For example, in Europe, it is possible to use 900 MHz band GSM system portable telephones throughout the whole of Europe, but within urban regions, it is possible to use 1.8 GHz DCS system portable telephones, in order to supplement the shortage of usable frequencies.

However, a DCS system portable telephone cannot be used in non-urban regions. Against this background, dual-band portable telephones have been developed which can be used in both GSM and DCS systems. These dual-band portable telephones are naturally equipped with a dual-frequency antenna which is capable of operating in the 900 MHz band and the 1.8 GHz band. In general, these dual-frequency antennas are constituted by respective antennas operating at respective frequencies, the two antennas being connected by means of isolating means, such as a choke coil, or the like, in order to prevent either antenna from affecting the operation of the other.

However, if a choke coil is adopted as isolation means, it is difficult to separate the signals across a broad frequency band. In other words, even if a choke coil is provided between antennas operating at respectively different frequencies, if broad frequency bands are used, such as mobile telephone bands, then a problem arises in that the respective antennas are unable to operate independently over the frequency bands, and they each affect the other and prevent satisfactory operation.

Moreover, if a mobile telephone is mounted in a vehicle, then an antenna is installed on the vehicle. A variety of antennas may be used for this antenna, but reception sensitivity can be increased if the antenna is installed on the roof of the vehicle, being the highest position thereof, and hence roof antennas have been preferred conventionally.

However, in a dual-frequency antenna using a choke coil, such as a trap coil, the antenna length will be great, the antenna will project a long way beyond the roof of the vehicle, and hence it will detract from the vehicle design.

DISCLOSURE OF THE INVENTION

The object of the present invention is to provide a low-profile dual-frequency antenna which operates satisfactorily in two different frequency bands, and in order to achieve the aforementioned object, the dual-frequency antenna of the present invention comprises: a linear element section; a crown section provided at the front end of said element section and having a downwardly inclined umbrella-shape; a matching stub for shorting an intermediate portion of said element section to earth; and a folded element which connects the power supply point of said element with the front end of said crown section; in such a manner that the antenna operates in two frequency bands.

In this manner, in the present invention, a folded element is provided connecting the front end of the crown section provided at the front end of the linear element and the power supply point of the linear element. By providing this folded element, it is possible to achieve an antenna operating in two frequency bands, and a frequency ratio of approximately 1:2 is achieved between the two frequency bands at which it operates.

Moreover, since the dual-frequency antenna according to the present invention is provided with a crown section which functions as a top loading element, at the front end of the linear element, it is possible to reduce the height of the dual-frequency antenna. Therefore, the dual-frequency antenna can be accommodated inside a small antenna case, and excellent design can be achieved since the antenna does not project significantly when attached to the roof of a vehicle.

Moreover, in the dual-frequency antenna according to the present invention, it is also possible to bend the front end of the crown section downwards to form a cylindrical section, and to accommodate the antenna inside a case consisting of a metal base having an installing section attachable to a vehicle formed on the lower face thereof, and a cover which fits into the metal base. Furthermore, it is also possible to accommodate a navigation antenna inside the case.

BRIEF DESCRIPTION OF THE DRAWINGS

FIG. 8(*b*) is a diagram showing directionality in a horizontal plane at 870 MHz of a vehicle antenna adopting a dual-frequency antenna according to an embodiment of the present invention;

FIG. 9(*b*) is a diagram showing directionality in a horizontal plane at 915 MHz and 960 MHz of a vehicle antenna adopting a dual-frequency antenna according to an embodiment of the present invention;

FIG. 10(*b*) is a diagram showing directionality in a horizontal plane at 1710 MHz and 1795 MHz of a vehicle antenna adopting a dual-frequency antenna according to an embodiment of the present invention;

FIG. 16(*b*) is a diagram showing directionality in a horizontal plane at 870 MHz of a vehicle antenna equipped with a GPS antenna adopting a dual-frequency antenna according to an embodiment of the present invention;

FIG. 17(*b*) is a diagram showing directionality in a horizontal plane at 915 MHz and 960 MHz of a vehicle antenna equipped with a GPS antenna adopting a dual-frequency antenna according to an embodiment of the present invention;

FIG. 18(*b*) is a diagram showing directionality in a horizontal plane at 1710 MHz and 1795 MHz of a vehicle antenna adopting a dual-frequency antenna equipped with a GPS antenna according to an embodiment of the present invention;

FIG. 24(*b*) is a diagram showing the directionality in a horizontal plane at 824 MHz of a vehicle antenna adopting a further dual-frequency antenna according to an embodiment of the present invention;

FIG. 25(*b*) is a diagram showing the directionality in a horizontal plane at 859 MHz and 894 MHz of a vehicle antenna adopting a further dual-frequency antenna according to an embodiment of the present invention;

FIG. 26(*b*) is a diagram showing the directionality in a horizontal plane at 1850 MHz and 1920 MHz of a vehicle antenna adopting a further dual-frequency antenna according to an embodiment of the present invention.

BEST MODE FOR CARRYING OUT THE INVENTION

Figure 1:
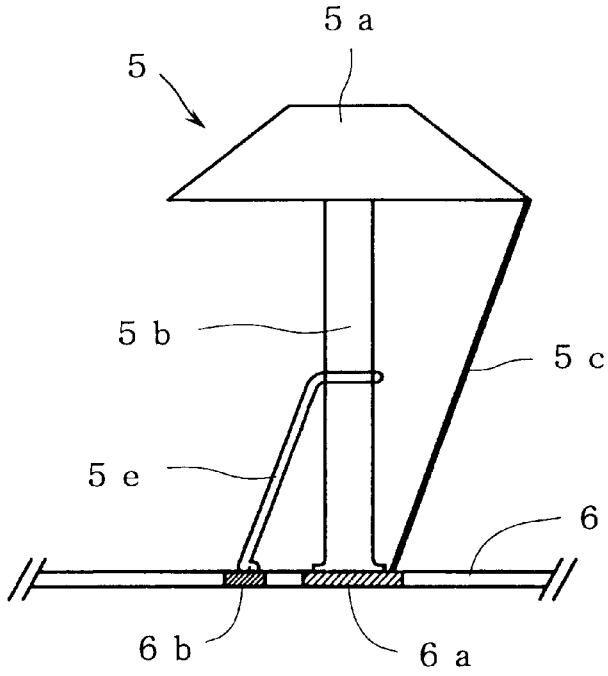
FIG. 1 is a diagram showing a first composition of an embodiment of the dual-frequency antenna according to the present invention.
Figure 2:
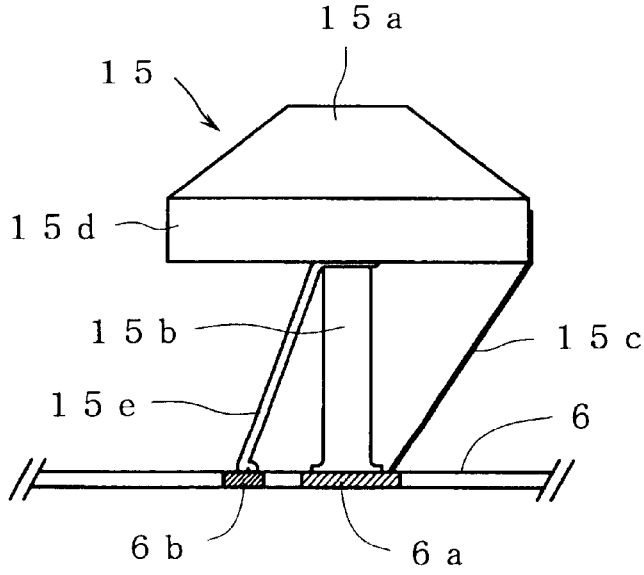
FIG. 2 is a diagram showing a second composition of an embodiment of the dual-frequency antenna according to the present invention.

FIG. 1 shows a first composition of an embodiment of a dual-frequency antenna according to the present invention, and FIG. 2 shows a second composition of an embodiment of a dual-frequency antenna according to the present invention.

The dual-frequency antenna 5 having the first composition shown in FIG. 1 is constituted by an umbrella-shaped crown element 5*a* which bends downwards as shown in the diagram, and a thick linear element section 5*b*, and a matching stub 5*e* is provided in such a manner that it connects an intermediate location of the element section 5*b* with an earth section 6*b* formed on the circuit board 6. The crown section 5*a* is connected to the element section 5*b* as a top loading section, and it is possible to shorten the length of the element section 5*b*. The matching stub 5*e* serves to match the dual-frequency antenna 5 with the coaxial cable leading from the dual-frequency antenna 5. Furthermore, the lower end of the element section 5*b* is connected to a power supply section 6*a* formed on the circuit board 6. In this case, the element section 5*b* is formed by a metal pipe, and the element section 5*b* may be affixed to the power supply section 6*a* by introducing a T-shaped pin inside the element section 5*b* from the rear surface of the circuit board 6. The characteristic composition of the dual-frequency antenna 5 having a first composition relating to this embodiment of the present invention is that the front end of the umbrella-shaped crown section 5*a* and the power supply section 6*a* are connected by means of a folded element 5*c*. Since the front end of the umbrella-shaped crown section 5*a* and the power supply section 6*a* are connected in this way by means of the folded element 5*c*, the dual-frequency antenna 5 operates in two frequency bands.

Since the crown section 5*a* of the dual-frequency antenna 5 is bent back to form a downward umbrella section, a large capacity is formed between the ground plane in contact with the earth section 6*b* and the crown section 5*a*, and hence the diameter of the crown section 5*a* can be reduced. For example, if this dual-frequency antenna 5 is adopted as a dual-frequency antenna for digital cellular systems such as a 900 MHz-hand (824 MHz–894 MHz) AMPS (Advanced Mobile Phone Service) system, and a 1.8 GHz bad (1850 MHz–1990 MHz) PCS (Personal Communication Service) system, then the diameter of the crown section 5*a* will be approximately 30 mm, and the height of the antenna can be reduced to a low profile of approximately 38 mm. This figure corresponds to at least a three-fold reduction in the diameter of the crown section, compared to a conventional crown antenna of the same antenna height.

Next, a dual-frequency antenna 15 having a second composition as shown in FIG. 2 is constituted by an umbrella-shaped crown section 15*a* bend in a downward fashion as shown in the diagram, and a thick linear element section 15*b*. The front end of the crown section 15*a*, which functions as a top loading element, is bent further downwards to form a cylindrical section 15*d*. Thereby, it is possible to shorten the length of the element section 15*b*. Moreover, a matching stub 15*e* is provided in such a manner that it connects between an intermediate position of the element section 15*b* and the earth section 6*b* formed on the circuit board 6. This matching stub 15*e* serves to match the dual-frequency antenna 15 to a coaxial cable leading from the dual-frequency antenna 15. Moreover, the lower end of the element section 15*b* is connected to a power supply section 6*a* formed on a circuit board 6. In this case, an element section 15*b* is formed by a metal pipe and the element section 15*b* may be affixed to the power supply section 6*a* by passing a T-shaped pin inside the element section 15*b* from the rear face of the circuit board 6. The characteristic composition of the dual-frequency antenna 15 having this second composition relating to an embodiment of the present invention is that the front end of the cylindrical section 15*d* in the umbrella-shaped crown section 15*a* is connected to the power supply section 6*a* by means of a folded element 15*c*. By connecting the front end of the umbrella-shaped crown section 15*a* to the power supply section 6*a* by means of a folded element 15*c* in this way, the dual-frequency antenna 15 operates in two frequency bands.

Since a cylindrical section 15*d* is provided in addition to bending the crown section 15*a* of the dual-frequency antenna 15 downwards in an umbrella shape, a large capacity is formed between the crown section 15*a* and the ground plane connected to the earth section 6*b*, and hence the diameter of the crown section 15*a* can be reduced. For example, if this dual-frequency antenna 15 is used as an antenna for digital cellular systems, such as a 900 MHz band (870 MHz–960 MHz) GSM (Global System for Mobile communications) system and a 1.8 GHz band (1710 MHz–1880 MHz) DCS (Digital Cellular System) system, then the diameter of the crown section 15*a* will be approximately 30 mm, and the antenna height can be reduced to a low profile of approximately 29.5 mm. In this way, it is possible further to reduce the profile of the antenna height.

Figure 3:
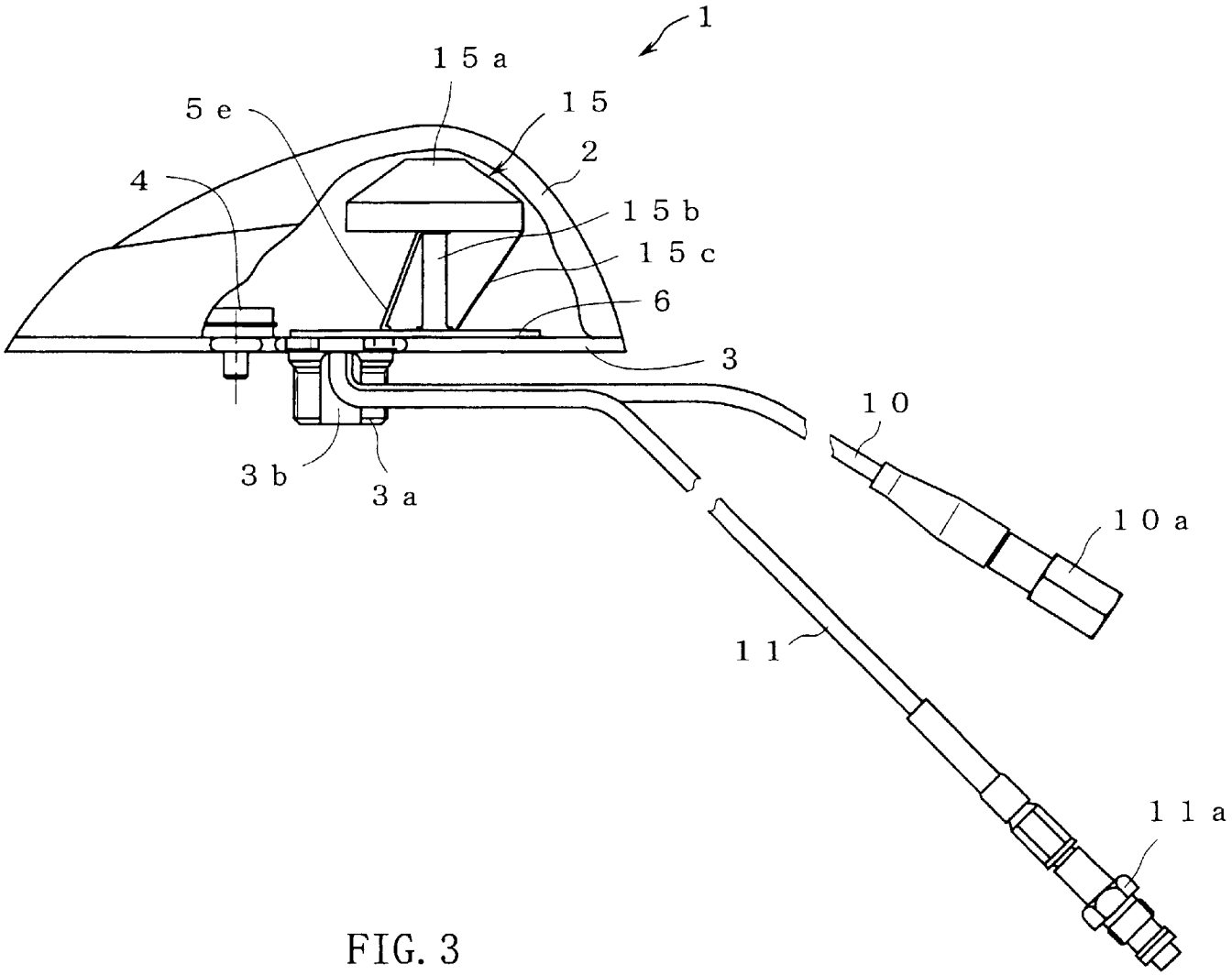
FIG. 3 is a diagram showing a composition wherein a dual-frequency antenna according to an embodiment of the present invention is applied to a vehicle antenna.

Next, FIG. 3 shows the composition in a case where a dual-frequency antenna 15 having a second composition relating to an embodiment of the present invention as described above, is applied to an antenna for a vehicle.

As shown in FIG. 3, the vehicle antenna 1 according to the present invention comprises a conductive metal base 3 having an elliptical shape, and an antenna case consisting of a cover 2 made from synthetic resin, which fits onto this metal base 3. A soft pad is provided on the lower face of the metal base 3, which is installed on the vehicle. The vehicle antenna 1 has a low profile and does not comprise any element section, or the like, which projects beyond the antenna case. Moreover, a base installation section 3*a* is formed in a projecting fashion on the rear face of the metal base 3, whereby the vehicle antenna 1 is affixed to the vehicle by fixing a fastening screw into an installation hole formed in the vehicle body. A clearance hole comprising a cutaway groove section 3*b* formed in the axial direction thereof is provided in the base installation section 3*a*, and a GPS cable 10 and telephone cable 11 are led into the antenna case from outside by means of this clearance hole.

A connector 10*a* for connecting a GPS device is provided on the front end of the GPS cable 10, and a connector 11*a* connected to a car telephone is provided on the front end of the telephone cable 11.

The GPS antenna receiving GPS signals and the dual-frequency antenna 15 for the car phone are accommodated inside the antenna case, as shown by the exposed view of the metal case 3 and the cover 2 in FIG. 3. The GPS antenna 4 is accommodated inside a GPS antenna holding section made from a metal case 3. The dual-frequency antenna 15 is electrically connected to the circuit board 6, as shown in FIG. 2, and is also mechanically fixed thereto. The circuit board 6 is fixed to the metal base 3. Moreover, the GPS cable introduced into the antenna case is connected to the GPS antenna 4 and a telephone cable 11 is connected to the dual-frequency antenna 15 on the circuit board 6.

Furthermore, when extracting the telephone cable 11 and the GPS cable 10 from the clearance hole of the base installation section 3*a*, as shown in FIG. 3, it is possible for the cables to be extracted virtually in parallel with the rear face of the metal base 3, by means of the cutaway groove section 3*b* formed in the axial direction of the base installation section 3*a*. Moreover, by leading the GPS cable 10 and the telephone cable 11 out from the lower end of the clearance hole, it is possible to make them lie virtually orthogonally with respect to the rear face of the metal base 3. Thereby, the telephone cable 11 and the GPS cable 10 can be extracted in accordance with the structure of the vehicle to which the vehicle antenna 1 is attached.

The dual-frequency antenna 15 is constituted by a linear element section 15*b* as shown in FIG. 2 and a circular crown section 15*a* provided at the front end of the element section 15*b*, which is bent downwards in an umbrella shape and comprises a cylindrical section 15*d*. This crown section 15*a* is affixed to the front end of the element section 15*b* by means of soldering, or the like. Moreover, a brim-shaped installing section is formed on the lower edge of the element section 15*b*, and this installing section is affixed to a power supply section 6*a* formed on a circuit board 6*a*, by means of soldering. When the circuit board 6 is installed on the metal base 3, the earth pattern of the circuit board 6 connects electrically with the metal base 3, in such a manner that the metal base 3 acts as a ground plane of the dual-frequency antenna 15.

Next, FIG. 4 to FIG. 19 show Smith charts indicating impedance characteristics, and graphs illustrating voltage stationary wave ratio (VSWR) characteristics and horizontal directionality characteristics for the vehicle antenna 1 shown in FIG. 3, in GSM/DCS frequency bands. Here, FIG. 4 to FIG. 11 show Smith charts and graphs indicating VSWR characteristics and horizontal directionality characteristics in GSM/DCS wave bands, in cases where a GPS antenna 4 is not installed, whilst FIG. 12 to FIG. 19 show Smith charts and graphs indicating VSWR characteristics and horizontal directionality characteristics in GSM/DCS wave bands, in cases where a GPS antenna 4 is installed.

Figure 4:
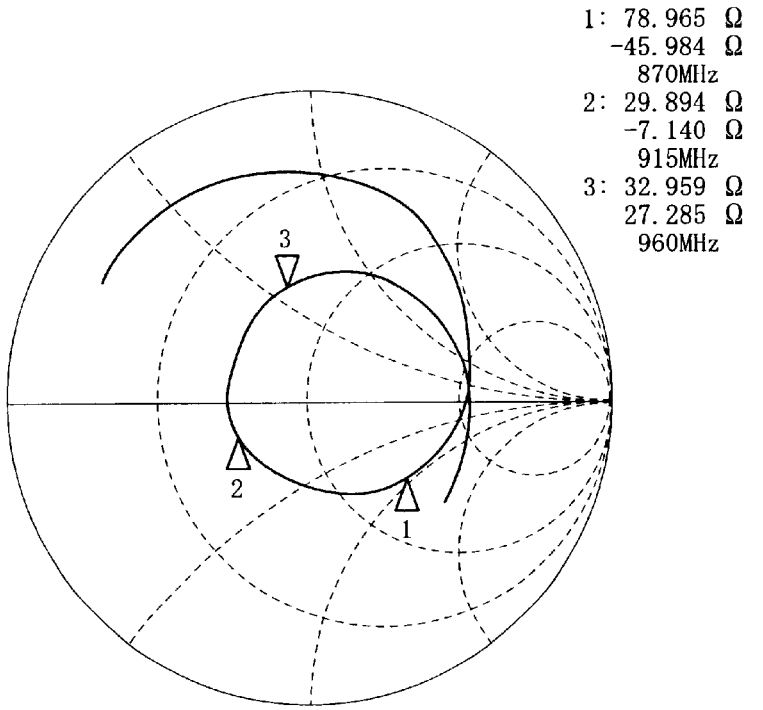
FIG. 4 is a Smith chart showing the impedance characteristics in a GSM frequency band of a vehicle antenna adopting the dual-frequency antenna according to an embodiment of the present invention.
Figure 5:
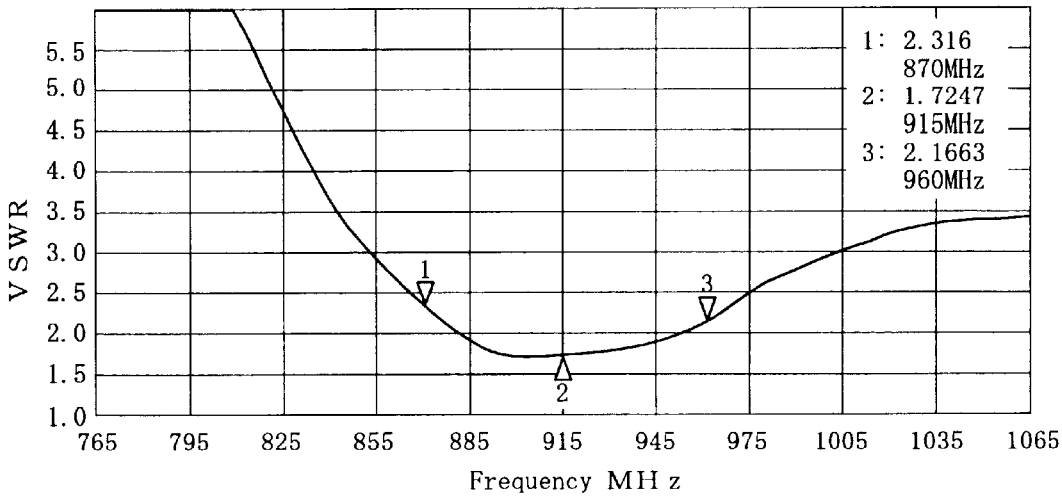
FIG. 5 is a diagram showing VSWR characteristics in a GSM frequency band of a vehicle antenna adopting the dual-frequency antenna according to an embodiment of the present invention.

FIG. 4 is a Smith chart in a GSM frequency band, where no GPS antenna 4 is provided, and FIG. 5 is a corresponding graph of VSWR characteristics. As shown in the diagram, the VSWR for the GSM frequency band is approximately 2.3 or lower.

Figure 6:
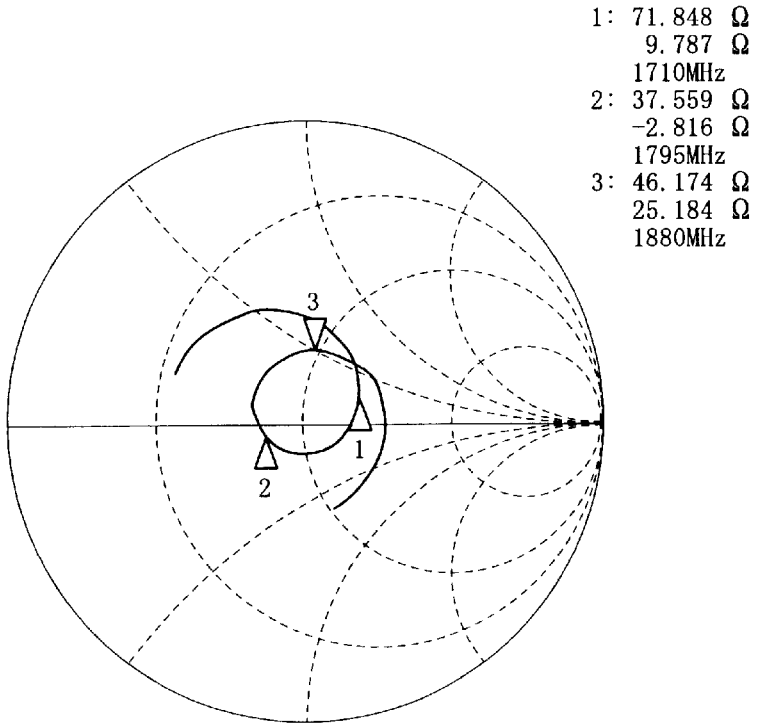
FIG. 6 is a Smith chart showing impedance characteristics in a DCS frequency band of a vehicle antenna adopting a dual-frequency antenna according to an embodiment of the present invention.
Figure 7:
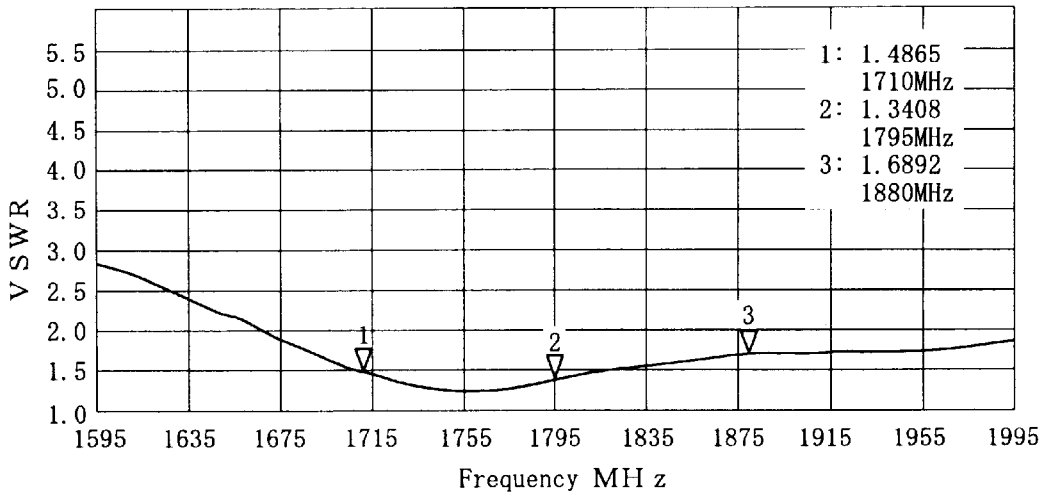
FIG. 7 is a diagram showing VSWR characteristics in a DCS frequency band of a vehicle antenna adopting a dual-frequency antenna according to an embodiment of present invention.

Moreover, FIG. 6 is a Smith chart in a DCS frequency band, where no GPS antenna 4 is provided, and FIG. 7 is a corresponding graph of VSWR characteristics. As shown in the diagram, the VSWR for the DCS frequency band is approximately 1.5 or lower.

From these VSWR characteristics and the impedance characteristics shown in the Smith charts, it can be seen that the vehicle antenna 1 adopting the dual-frequency antenna 15 operates in both the GSM and DCS frequency bands.

Figure 8A:
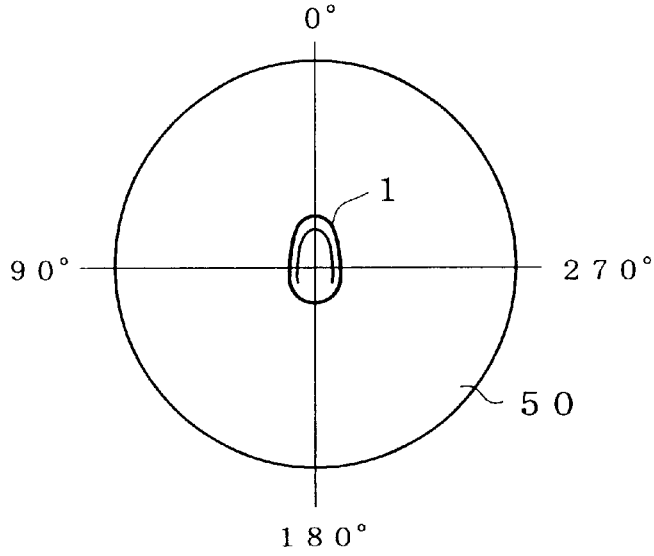
FIG. 8(*a*) is a diagram showing directionality in a horizontal plane at 870 MHz of a vehicle antenna adopting a dual-frequency antenna according to an embodiment of the present invention.
Figure 8B:
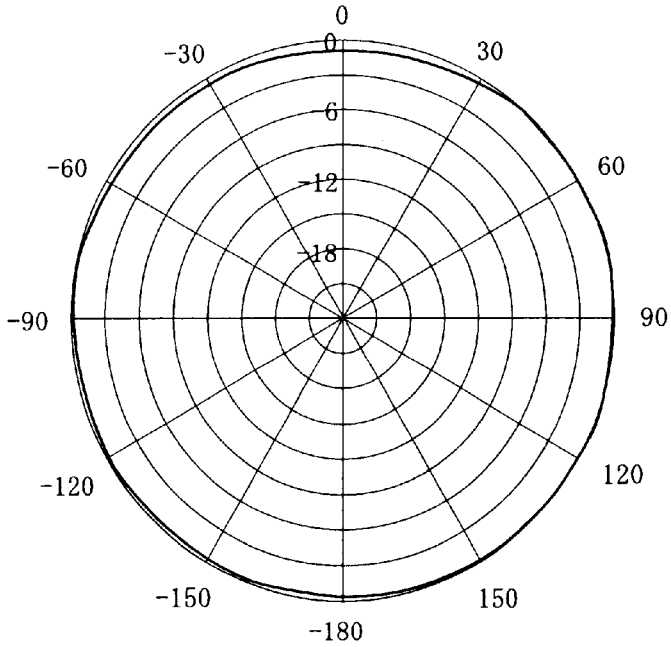
Figure 9A:
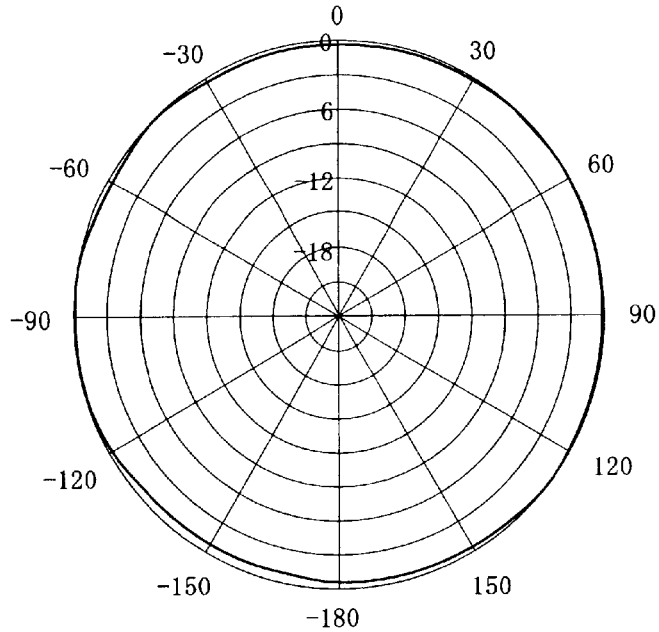
FIG. 9(*a*) is a diagram showing directionality in a horizontal plane at 915 MHz and 960 MHz of a vehicle antenna adopting a dual-frequency antenna according to an embodiment of the present invention.
Figure 9B:
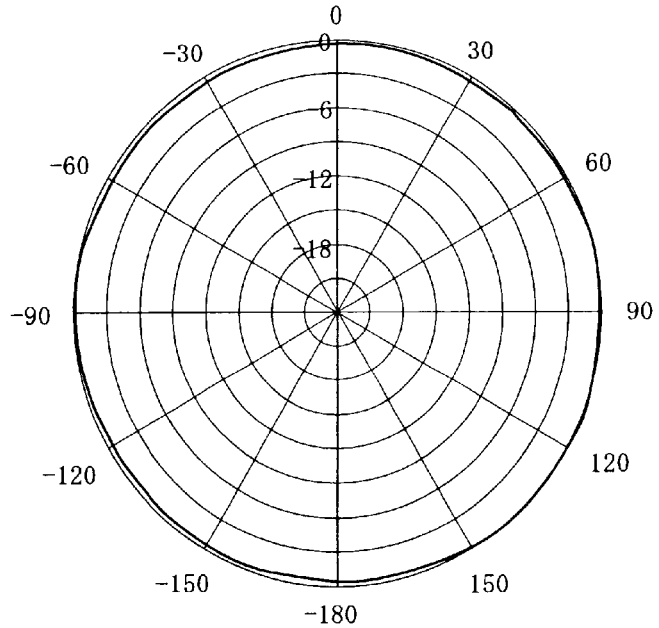

FIG. 8(*b*) is a diagram showing horizontal plane directionality at 870 MHz, which is the lowest GSM frequency, in a case where no GPS antenna 4 is provided when the vehicle antenna 1 is installed as illustrated in FIG. 8(*a*). In this case, the antenna gain corresponding to a ¼ wavelength whip antenna is approximately −1.04 dB. FIG. 9(*a*) is a diagram showing horizontal plane directionality at 915 MHz, which is a central GSM frequency in the same circumstances, and in this case, the antenna gain corresponding to a ¼ wavelength whip antenna is approximately −0.81 dB. FIG. 9(*b*) is a diagram showing horizontal plane directionality at 960 MHz, which is the maximum GSM frequency, in the same circumstances, and in this case, the antenna gain corresponding to a ¼ wavelength whip antenna is approximately −1.53 dB. By referring to the diagrams showing these horizontal plane directionality characteristics, it can be seen that satisfactory, virtually circular directionality characteristics in a horizontal plane are obtained in the GSM frequency band.

Figure 10A:
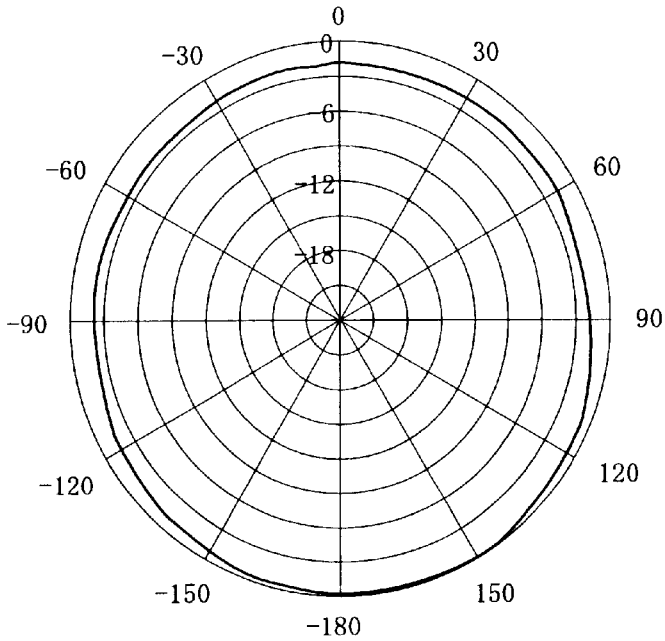
FIG. 10(*a*) is a diagram showing directionality in a horizontal plane at 1710 MHz and 1795 MHz of a vehicle antenna adopting a dual-frequency antenna according to an embodiment of the present invention.
Figure 10B:
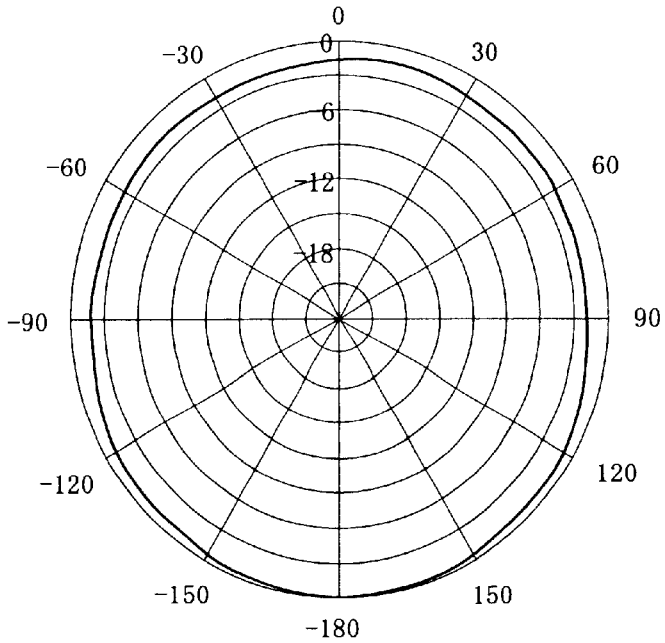
Figure 11:
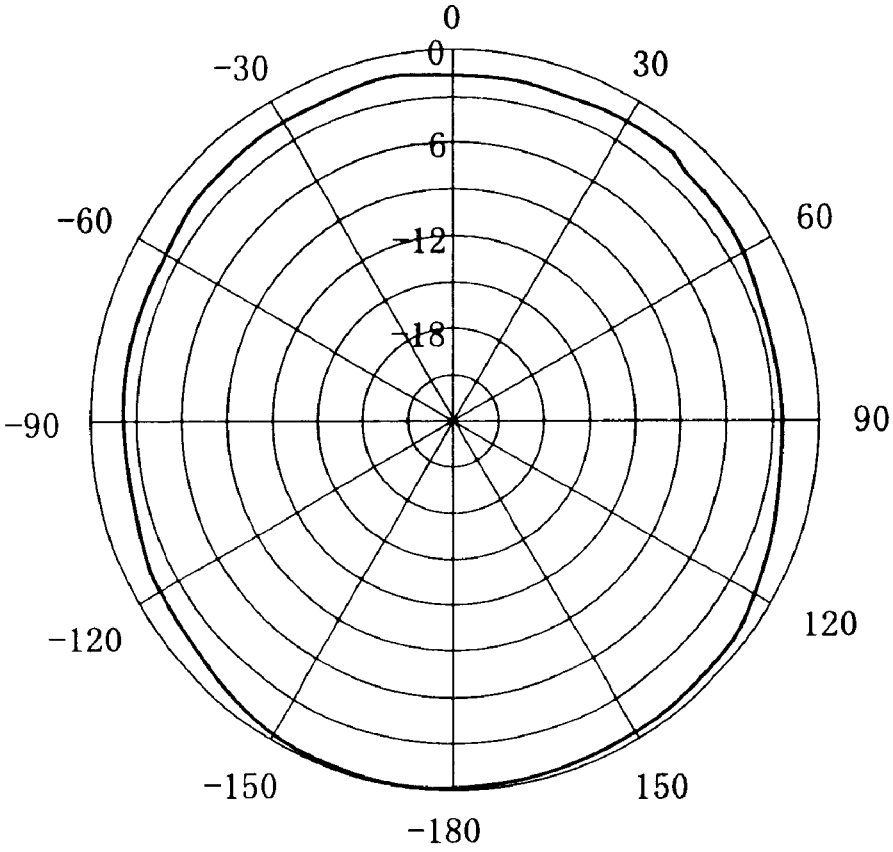
FIG. 11 is a diagram showing directionality in a horizontal plane at 1880 MHz of a vehicle antenna adopting a dual-frequency antenna according to an embodiment of the present invention.

FIG. 10(*a*) is a diagram showing horizontal plane directionality at 1710 MHz, which is the lowest DCS frequency, in a case where no GPS antenna 4 is provided when the vehicle antenna 1 is installed as illustrated in FIG. 8(*a*). In this case, the antenna gain corresponding to a ¼ wavelength whip antenna is approximately −1.33 dB. FIG. 10(*b*) is a diagram showing horizontal plane directionality at 1795 MHz, which is a central DCS frequency in the same circumstances, and in this case, the antenna gain corresponding to a ¼ wavelength whip antenna is approximately −0.3 dB. FIG. 11(*a*) is a diagram showing horizontal plane directionality at 1880 MHz, which is the maximum DCS frequency, in the same circumstances, and in this case, the antenna gain corresponding to a ¼ wavelength whip antenna is approximately −1.17 dB. By referring to the diagrams showing these horizontal plane directionality characteristics, it can be seen that satisfactory, virtually circular directionality characteristics in a horizontal plane are obtained in the DCS frequency band.

From these diagrams showing horizontal plane directionality characteristics, it can be seen that the vehicle antenna 1 adopting the dual-frequency antenna 15 operates satisfactorily in both the GSM and DCS frequency bands.

Figure 12:
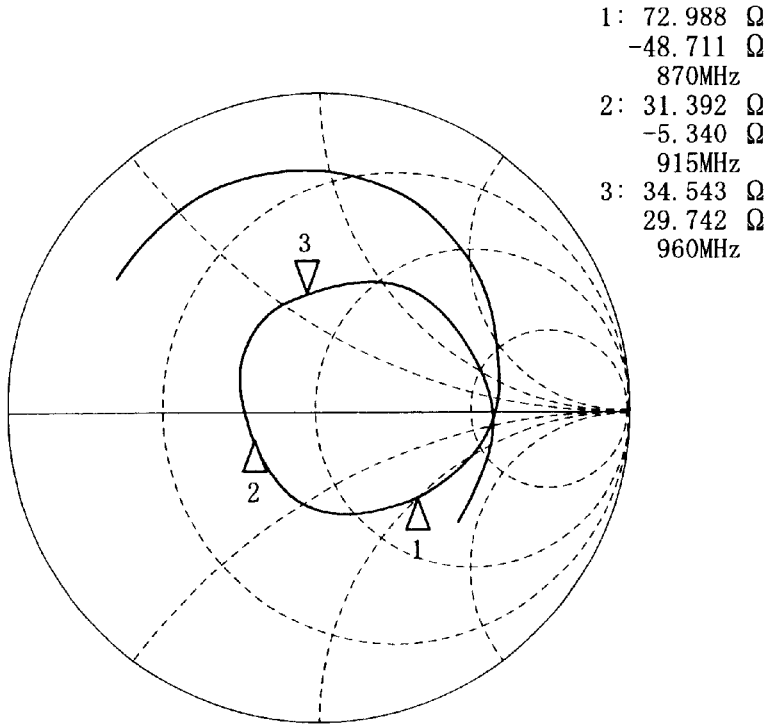
FIG. 12 is a Smith chart showing impedance characteristics in a GSM frequency band of a vehicle antenna equipped with GPS antenna adopting a dual-frequency antenna according to an embodiment of the present invention.
Figure 13:
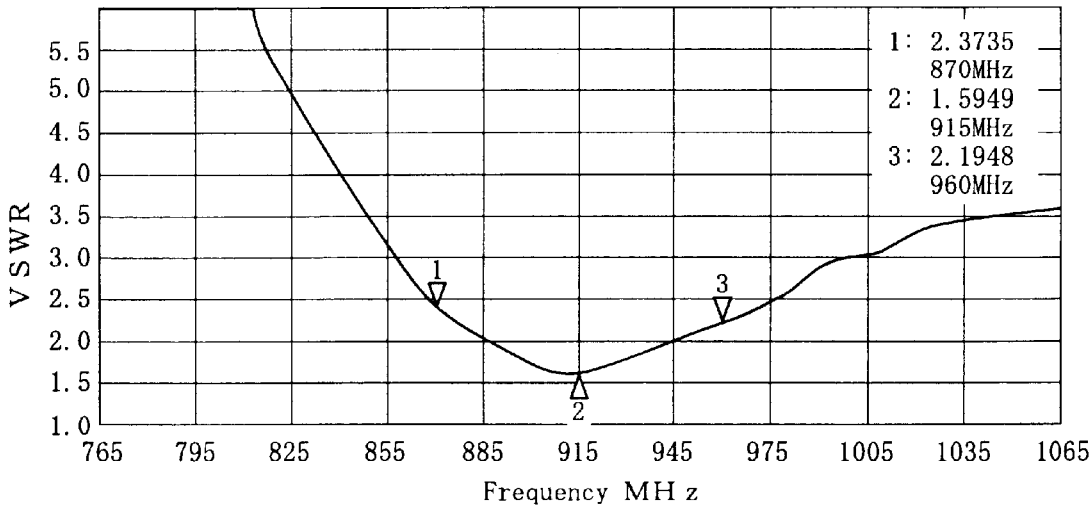
FIG. 13 is a diagram showing VSWR characteristics in a GSM frequency band of a vehicle antenna equipped with GPS antenna adopting a dual-frequency antenna according to an embodiment of the present invention.

FIG. 12 is a Smith chart showing impedance characteristics in the GSM frequency band when there is a GPS antenna 4, and FIG. 13 is a graph showing VSWR characteristics thereof. As shown in the drawings, the VSWR in the GSM frequency band is approximately 2.3 or less.

Figure 14:
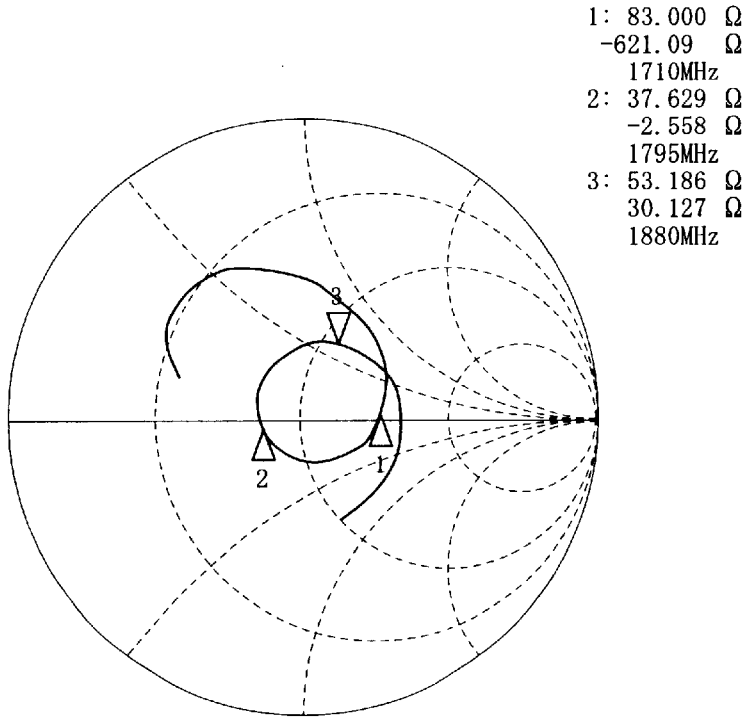
FIG. 14 is a Smith chart showing impedance characteristics in a DCS frequency band of a vehicle antenna equipped with GPS antenna adopting a dual-frequency antenna according to an embodiment of the present invention.
Figure 15:
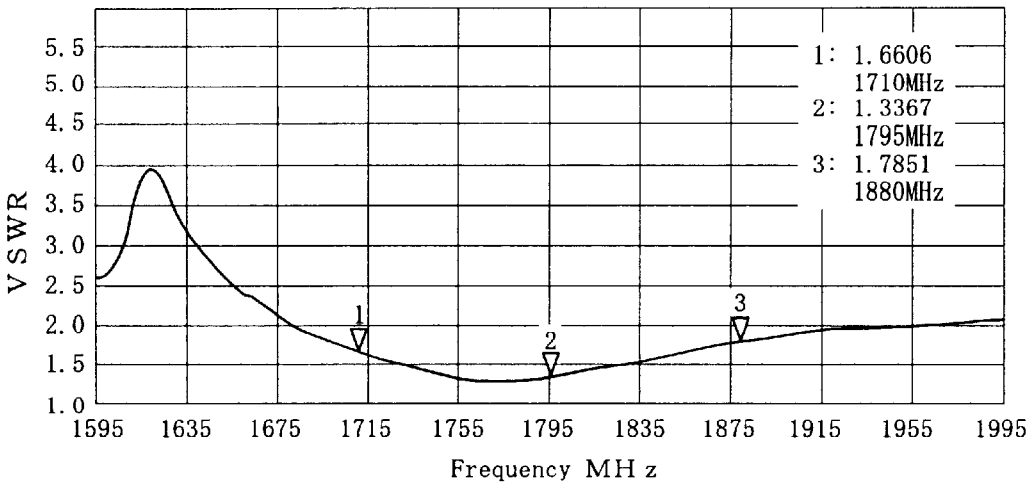
FIG. 15 is a diagram showing VSWR characteristics in a DCS frequency band of a vehicle antenna equipped with GPS antenna adopting a dual-frequency antenna according to an embodiment of the present invention.

FIG. 14 is a Smith chart showing impedance characteristics in the DCS frequency band when there is a GPS antenna 4, and FIG. 15 is a graph showing VSWR characteristics thereof. As shown in the drawings, the VSWR in the DCS frequency band is approximately 1.8 or less.

From the VSWR characteristics and the impedance characteristics shown in the Smith charts, it can be seen that characteristics deteriorate slightly if there is a GPS antenna 4, but a vehicle antenna 1 adopting the dual-frequency antenna 15 operates satisfactorily in both GSM and DCS frequency bands.

Figure 16A:
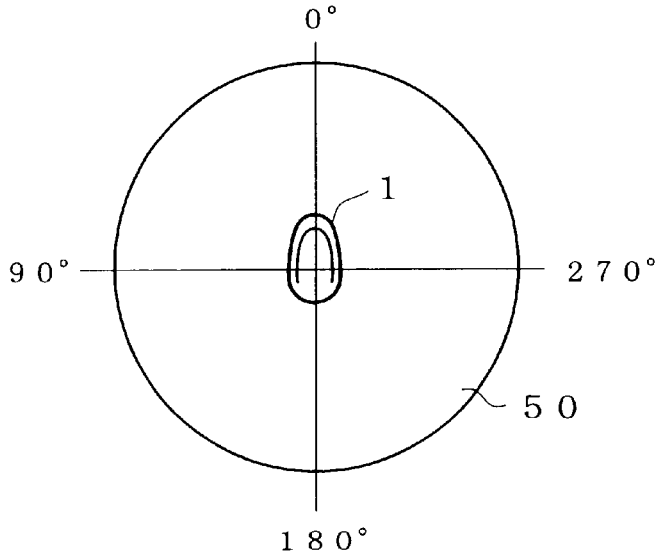
FIG. 16(*a*) is a diagram showing directionality in a horizontal plane at 870 MHz of a vehicle antenna equipped with a GPS antenna adopting a dual-frequency antenna according to an embodiment of the present invention.
Figure 16B:
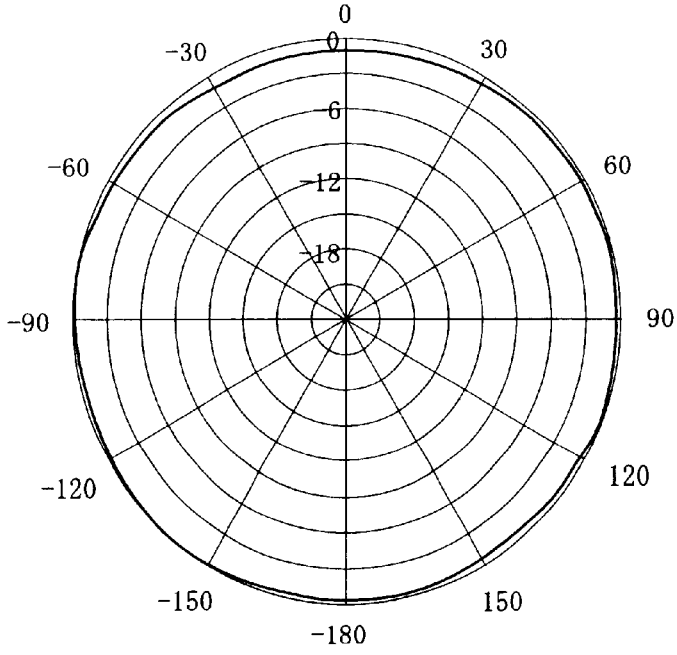
Figure 17A:
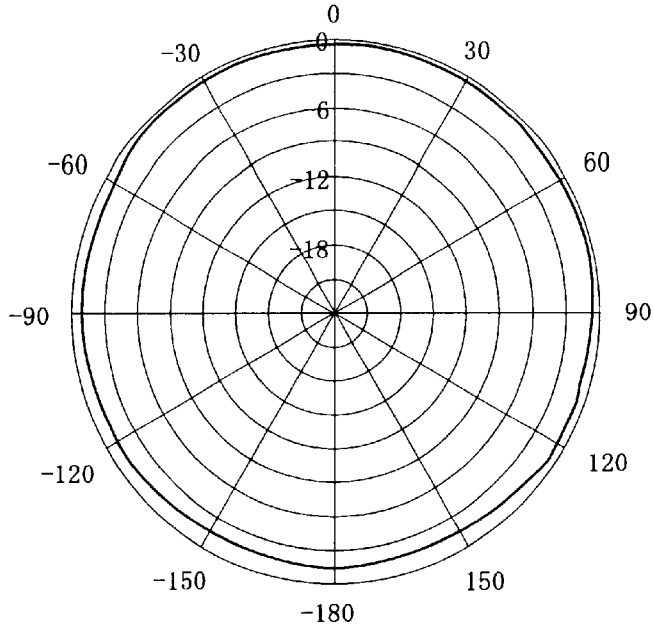
FIG. 17(*a*) is a diagram showing directionality in a horizontal plane at 915 MHz and 960 MHz of a vehicle antenna equipped with a GPS antenna adopting a dual-frequency antenna according to an embodiment of the present invention.
Figure 17B:
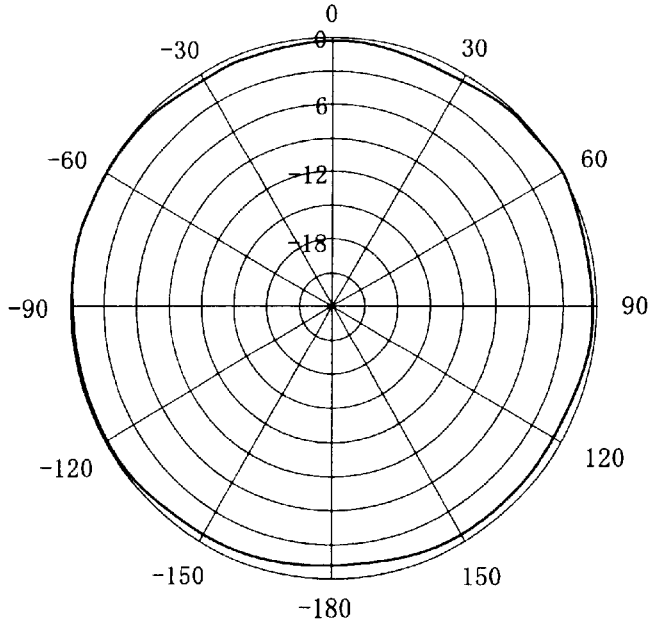

FIG. 16(*b*) is a diagram showing horizontal plane directionality at 870 MHz, which is the lowest GSM frequency, in a case where a GPS antenna 4 is provided when the vehicle antenna 1 is installed as illustrated in FIG. 16(*a*). In this case, the antenna gain corresponding to a ¼ wavelength whip antenna is approximately −1.23 dB. FIG. 17(*a*) is a diagram showing horizontal plane directionality at 915 MHz, which is a central GSM frequency in the same circumstances, and in this case, the antenna gain corresponding to a ¼ wavelength whip antenna is approximately −0.78 dB. FIG. 17(*b*) is a diagram showing horizontal plane directionality at 960 MHz, which is the maximum GSM frequency, in the same circumstances, and in this case, the antenna gain corresponding to a ¼ wavelength whip antenna is approximately −1.67 dB. By referring to these horizontal plane directionality characteristics, it can be seen that although characteristics deteriorate slightly when a GPS antenna 4 is provided, satisfactory, virtually circular directionality characteristics in a horizontal plane are obtained in the GSM frequency band.

Figure 18A:
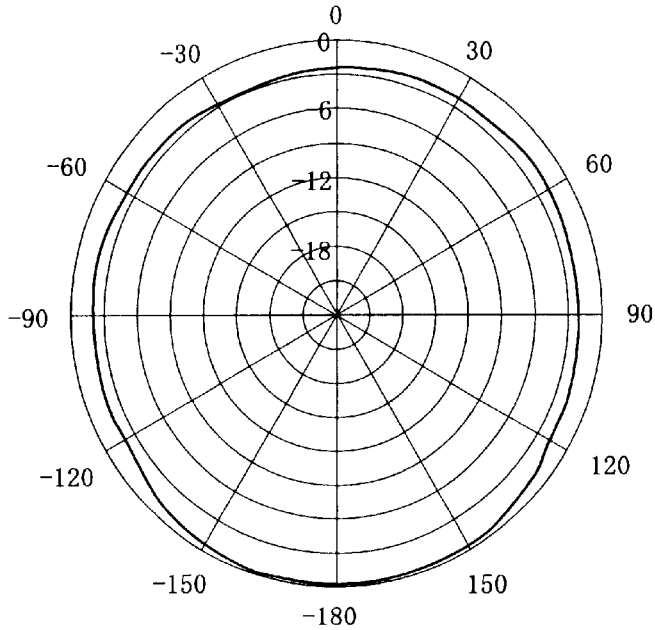
FIG. 18(*a*) is a diagram showing directionality in a horizontal plane at 1710 MHz and 1795 MHz of a vehicle antenna adopting a dual-frequency antenna equipped with a GPS antenna according to an embodiment of the present invention.
Figure 18B:
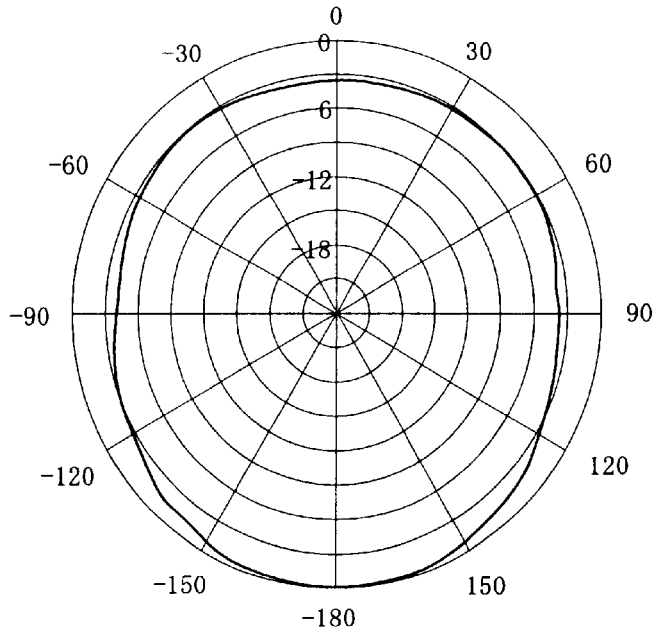
Figure 19:
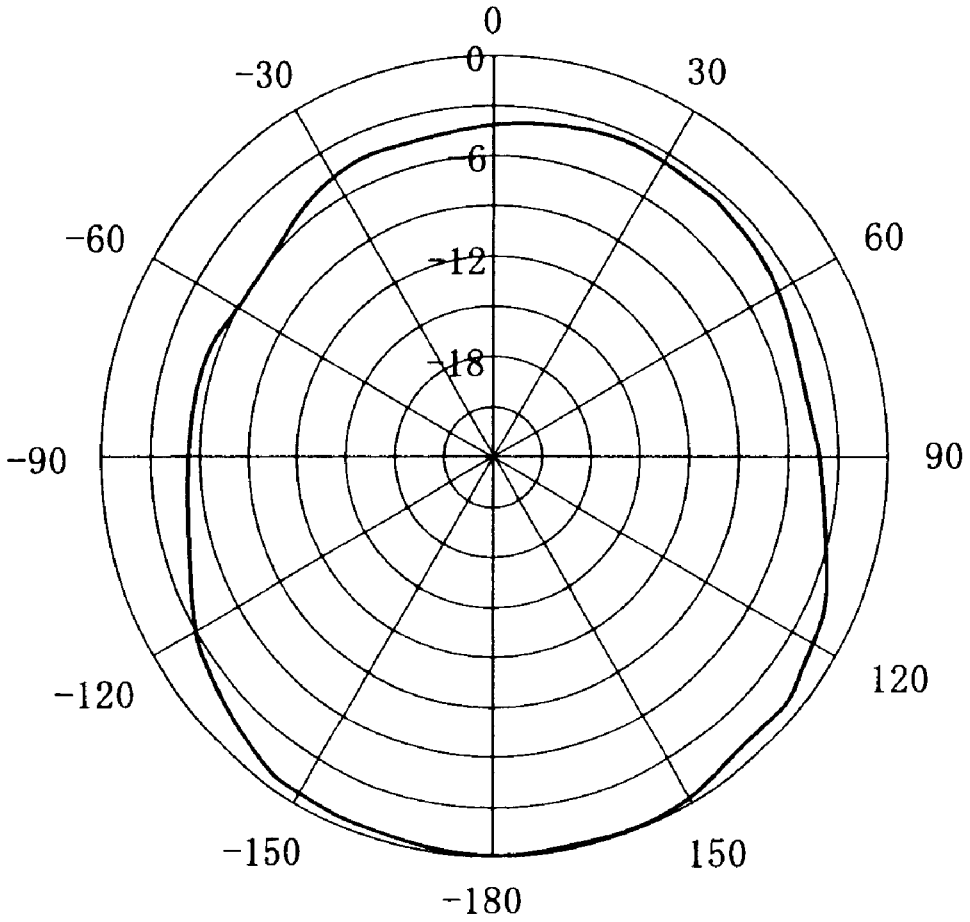
FIG. 19 is a diagram showing directionality in a horizontal plane at 1880 MHz of a vehicle antenna equipped with a GPS antenna adopting a dual-frequency antenna according to an embodiment of the present invention.

FIG. 18(*a*) is a diagram showing horizontal plane directionality at 1710 MHz, which is the lowest DCS frequency, in a case where a GPS antenna 4 is provided when the vehicle antenna 1 is installed as illustrated in FIG. 16(*a*). In this case, the antenna gain corresponding to a ¼ wavelength whip antenna is approximately −1.81 dB. FIG. 18(*b*) is a diagram showing horizontal plane directionality at 1795 MHz, which is a central DCS frequency in the same circumstances, and in this case, the antenna gain corresponding to a ¼ wavelength whip antenna is approximately −0.22 dB. FIG. 19(*a*) is a diagram showing horizontal plane directionality at 1880 MHz, which is the maximum DCS frequency, in the same circumstances, and in this case, the antenna gain corresponding to a ¼ wavelength whip antenna is approximately −0.04 dB. By referring to these horizontal plane directionality characteristics, it can be seen that although characteristics deteriorate slightly when a GPS antenna 4 is provided, satisfactory, virtually circular directionality characteristics in a horizontal plane are obtained in the DCS frequency band.

From these horizontal plane directionality characteristics, it can be seen that although characteristics deteriorate slightly when a GPS antenna 4 is provided, the vehicle antenna 1 adopting the dual-frequency antenna 15 operates satisfactorily in both the GSM and DCS frequency bands.

Next, FIG. 20 to FIG. 27 show Smith charts indicating impedance characteristics, and graphs illustrating voltage stationary wave ratio (VSWR) characteristics and horizontal directionality characteristics in AMPS/PCS frequency bands, when the first dual-frequency antenna 5 in FIG. 1 is used as a vehicle antenna 1.

Figure 20:
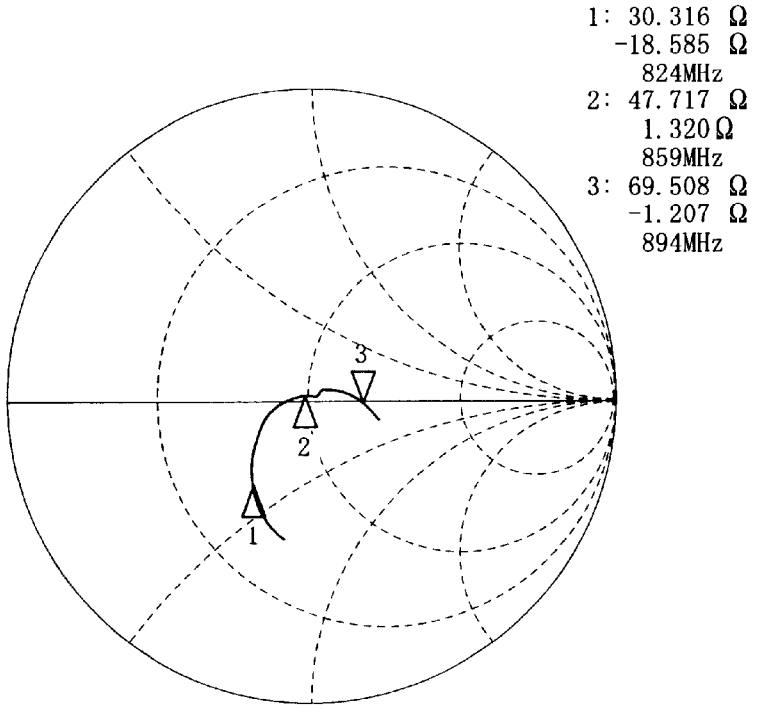
FIG. 20 is a Smith chart showing impedance characteristics in an AMPS frequency band of a vehicle antenna adopting a further dual-frequency antenna according to an embodiment of the present invention.
Figure 21:
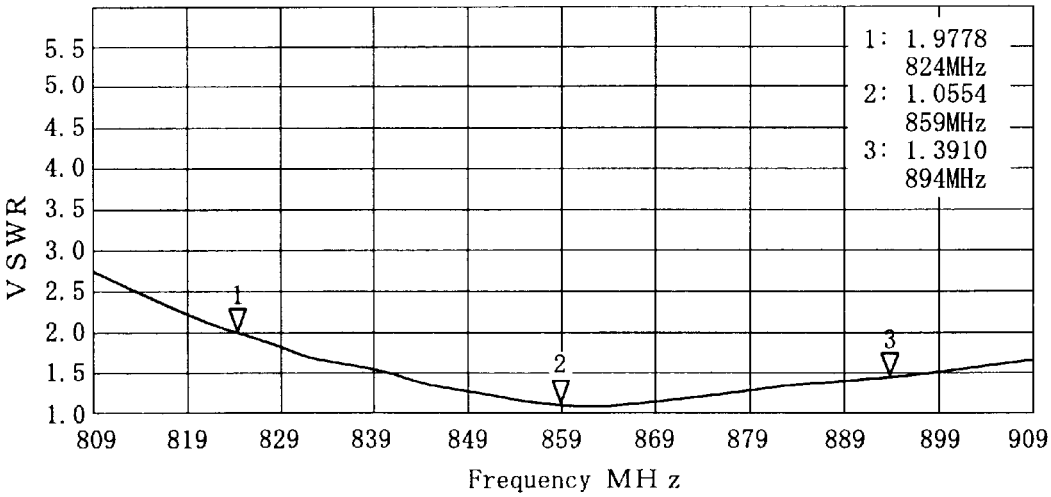
FIG. 21 is a diagram showing VSWR characteristics in an AMPS frequency band of a vehicle antenna adopting a further dual-frequency antenna according to an embodiment of present invention.

FIG. 20 is a Smith chart showing impedance characteristics in an AMPS frequency band, and FIG. 21 is a corresponding graph of VSWR characteristics. As shown in the diagram, the VSWR for the AMPS frequency band is approximately 2.0 or lower.

Figure 22:
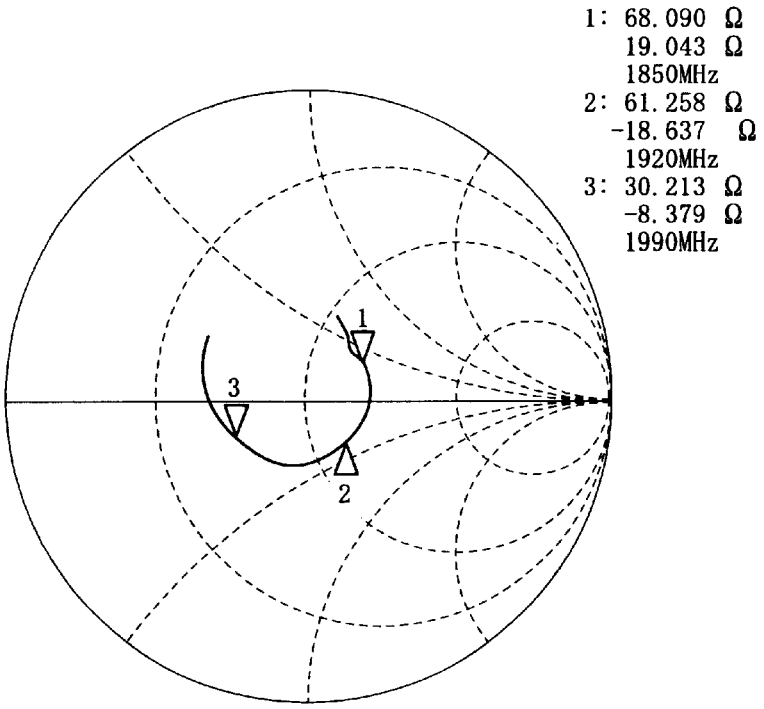
FIG. 22 is a Smith chart showing impedance characteristics in a PCS frequency band of a vehicle antenna adopting a further dual-frequency antenna according to an embodiment of the present invention.
Figure 23:
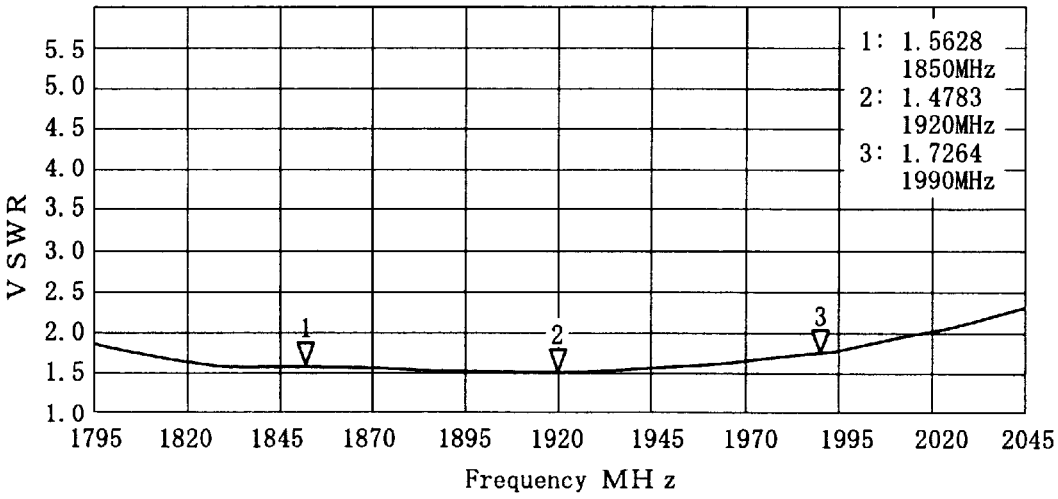
FIG. 23 is a diagram showing VSWR characteristics in a PCS frequency band of a vehicle antenna adopting a further dual-frequency antenna according to an embodiment of the present invention.

Moreover, FIG. 22 is a Smith chart showing impedance characteristics in a PCS frequency band, and FIG. 23 is a corresponding graph of VSWR characteristics. As shown in the diagram, the VSWR for the PCS frequency band is approximately 1.7 or lower.

From these VSWR characteristics and the impedance characteristics shown in the Smith charts, it can be seen that the vehicle antenna 1 adopting the dual-frequency antenna 5 operates in both the AMPS and PCS frequency bands.

Figure 24A:
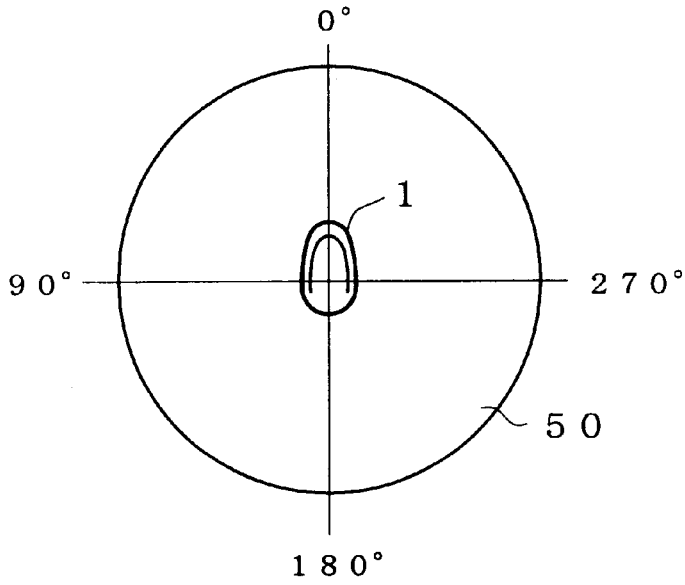
FIG. 24(*a*) is a diagram showing the directionality in a horizontal plane at 824 MHz of a vehicle antenna adopting a further dual-frequency antenna according to an embodiment of the present invention.
Figure 24B:
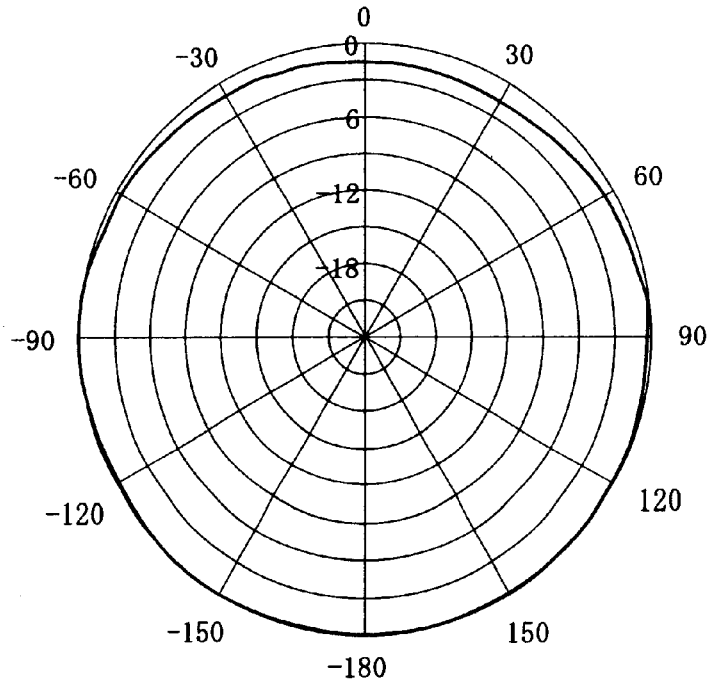
Figure 25:
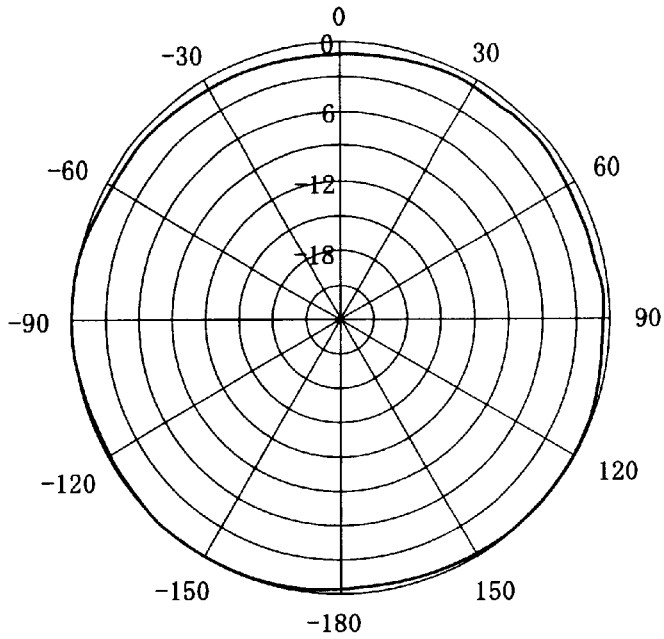
FIG. 25(*a*) is a diagram showing the directionality in a horizontal plane at 859 MHz and 894 MHz of a vehicle antenna adopting a further dual-frequency antenna according to an embodiment of the present invention.
Figure 25:
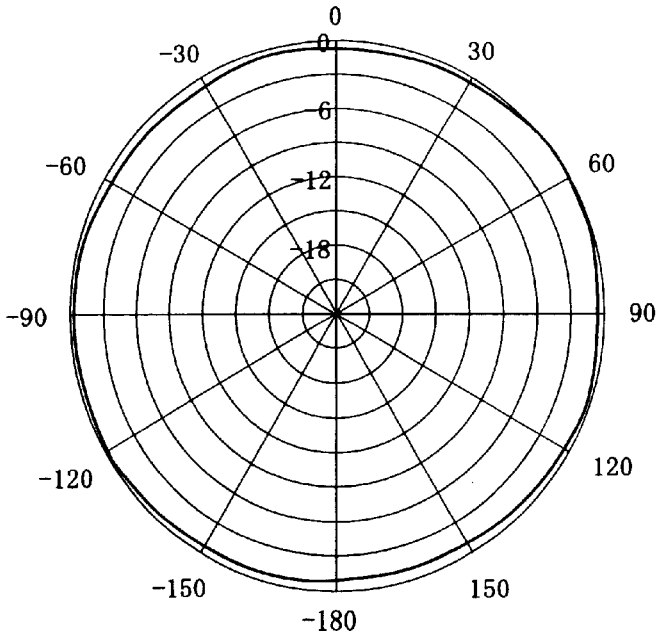

FIG. 24(*b*) is a diagram showing horizontal plane directionality at 824 MHz, which is the lowest AMPS frequency, in a case where the vehicle antenna 1 is installed as illustrated in FIG. 24(*a*). In this case, the antenna gain corresponding to a ¼ wavelength whip antenna is approximately −1.19 dB. FIG. 25(*a*) is a diagram showing horizontal plane directionality at 859 MHz, which is a central AMPS frequency in the same circumstances, and in this case, the antenna gain corresponding to a ¼ wavelength whip antenna is approximately −0.64 dB. FIG. 25(*b*) is a diagram showing horizontal plane directionality at 894 MHz, which is the maximum AMPS frequency, in the same circumstances, and in this case, the antenna gain corresponding to a ¼ wavelength whip antenna is approximately −0.81 dB. By referring to these horizontal plane directionality characteristics, it can be seen that satisfactory, virtually circular directionality characteristics in a horizontal plane are obtained in the AMPS frequency band.

Figure 26:
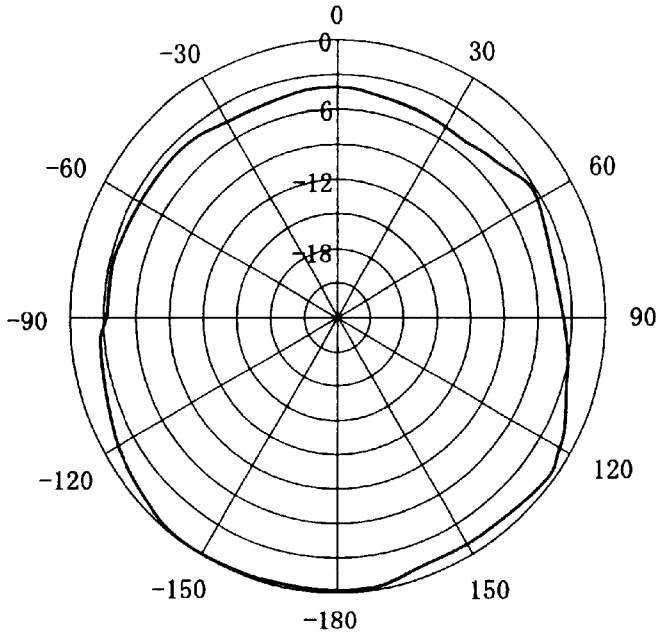
FIG. 26(*a*) is a diagram showing the directionality in a horizontal plane at 1850 MHz and 1920 MHz of a vehicle antenna adopting a further dual-frequency antenna according to an embodiment of the present invention.
Figure 26:
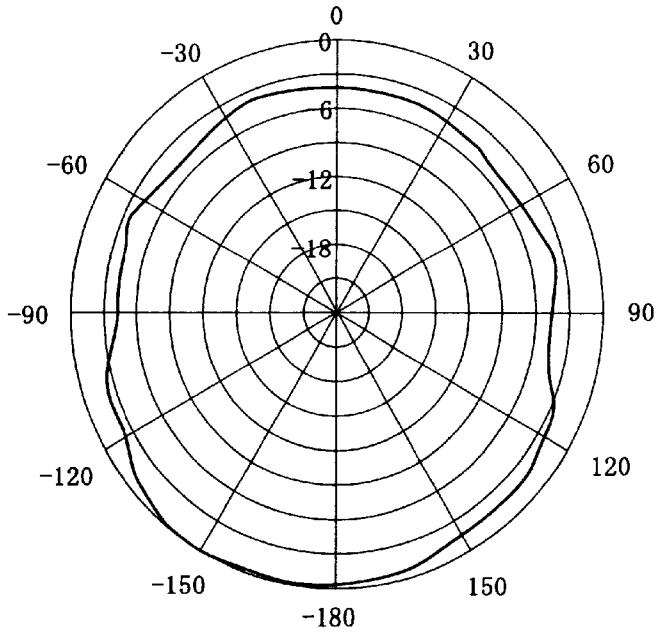
Figure 27:
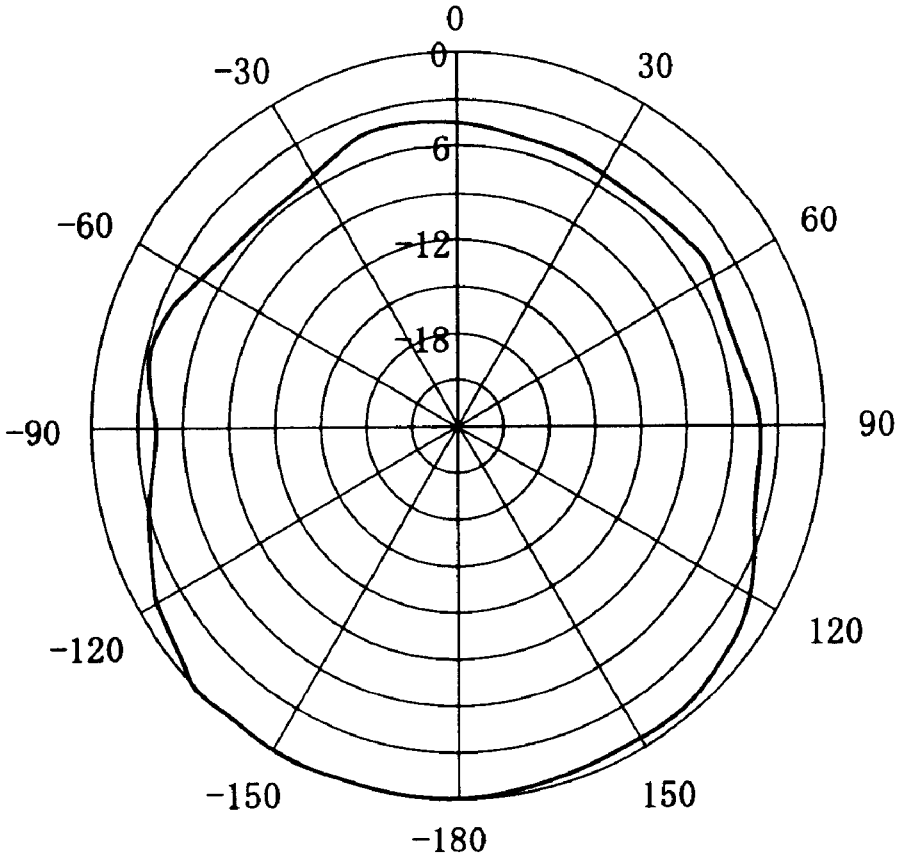
FIG. 27 is a diagram showing the directionality in a horizontal plane at 1990 MHz of a vehicle antenna adopting a further dual-frequency antenna according to an embodiment of the present invention.

FIG. 26(*a*) is a diagram showing horizontal plane directionality at 1850 MHz, which is the lowest PCS frequency, when the vehicle antenna 1 is installed as illustrated in FIG. 24(*a*). In this case, the antenna gain corresponding to a ¼ wavelength whip antenna is approximately −1.39 dB. FIG. 26(*b*) is a diagram showing horizontal plane directionality at 1920 MHz, which is a central PCS frequency in the same circumstances, and in this case, the antenna gain corresponding to a ¼ wavelength whip antenna is approximately 1.28 dB. FIG. 27 is a diagram showing horizontal plane directionality at 1990 MHz, which is the maximum PCS frequency, in the same circumstances, and in this case, the antenna gain corresponding to a ¼ wavelength whip antenna is approximately 0.5 dB. By referring to these horizontal plane directionality characteristics, it can be seen that satisfactory, virtually circular directionality characteristics in a horizontal plane are obtained in the PCS frequency band.

From these horizontal plane directionality characteristics, it can be seen that the vehicle antenna 1 adopting the dual-frequency antenna 5 operates satisfactorily in both the AMPS and PCS frequency bands.

In the foregoing description, the dual-frequency antenna relating to the present invention was operated in two frequency bands, GSM and DCS, or AMPS and PCS, but the present invention is not limited to this and may be applied to any communications system having two frequency bands wherein the frequency ratio is approximately 1:2.

INDUSTRIAL APPLICABILITY

By adopting the foregoing composition, the present invention provides a folded element connecting the front end of a crown section provided on the front end of a linear element, and the power supply point of the linear element. By providing a folded element in this way, it is possible to achieve an antenna which operates in two frequency bands. The frequency ration between the two frequency bands in which it operates is approximately 1:2.

Moreover, since the dual-frequency antenna according to the present invention, is provided with a crown section which functions as a top loading element at the front end of a linear element, it is possible to reduce the height of the dual-frequency antenna. Therefore, the dual-frequency antenna can be accommodated inside a small antenna case, and excellent antenna design can be achieved since the antenna does not project significantly when attached to the roof of a vehicle.

What is claimed is:

1. A dual-frequency antenna which operates in two freqency bands characterized by comprising:

a linear element section having a power supply point end and a front end;

a crown section provided at the front end of said linear element section and having a downwardly inclined umbrella-shape;

a matching stub for shorting a portion of said linear element section to earth; and a folded element which connects the power supply point end of said element with the front end of said crown section.

2. The dual-frequency antenna according to claim 1, characterized in that the front end of said crown section is bent downwards to form a cylindrical section.

3. The dual-frequency antenna according to claim 1, characterized in that the frequency ratio of said two frequency bands is approximately 1:2.

4. The dual-frequency antenna according to claim 1, characterized by being accommodated inside a case constituted by a metal base having an installing section that is attachable to a vehicle and formed on the lower face thereof, and a cover which fits into said metal base.

5. The dual-frequency antenna according to claim 1, characterized in that a navigation antenna is also accommodated inside said case.

6. A dual frequency antenna which operates in two frequency bands according to claim 1, wherein said matching stub connects a portion of said linear element section which is intermediate said power supply point end and said front end to earth.

* * * * *